US005083034A

United States Patent [19]

Frank et al.

[11] Patent Number: 5,083,034

[45] Date of Patent: Jan. 21, 1992

[54] MULTI-WAVELENGTH TARGET SYSTEM

[75] Inventors: Jack D. Frank, Long Beach; Gustav Hubert, San Gabriel, both of Calif.

[73] Assignee: Hughes Aircraft Company, Los Angeles, Calif.

[21] Appl. No.: 478,892

[22] Filed: Feb. 12, 1990

[51] Int. Cl.[5] ..... F21S 3/14

[52] U.S. Cl. ..... 250/494.1; 250/504 R

[58] Field of Search ..... 250/493.1, 494.1, 504 R; 434/22, 16

[56] References Cited

U.S. PATENT DOCUMENTS

| | | | |
|---|---|---|---|
| 4,260,160 | 4/1981 | Ejnell et al. | 250/504 R |
| 4,387,301 | 6/1983 | Wirick et al. | 250/252.1 A |
| 4,422,758 | 12/1983 | Godfrey et al. | 356/152 |
| 4,767,122 | 8/1988 | Rusche | 434/16 |
| 4,769,527 | 9/1988 | Hart et al. | 250/494.01 |
| 4,781,593 | 11/1988 | Birge et al. | 434/16 |
| 4,820,929 | 4/1989 | Modisette et al. | 250/493.1 |
| 4,929,841 | 5/1990 | Chang | 250/504 R |
| 4,930,504 | 6/1990 | Diamantopoulos et al. | 250/494.1 |
| 4,996,437 | 2/1991 | Hendrick | 250/504 R |

FOREIGN PATENT DOCUMENTS

| | | |
|---|---|---|
| 0063415 | 10/1982 | European Pat. Off. . |
| 0156070 | 10/1985 | European Pat. Off. . |

*Primary Examiner*—Bruce C. Anderson

*Attorney, Agent, or Firm*—Michael W. Sales; Wanda Denson-Low

[57] ABSTRACT

A target system adapted for use in a cassegrain reflective optical collimator system comprises a single target pattern including at least one visible target, at least one near infrared target and at least one far infrared target. This single test target pattern is joined to a heat-transmitting target support member positioned behind the target pattern, to a heater behind the heat-transmitting target support member, to an insulator behind the heating means, and to an illuminator for each of the targets in the single target pattern behind the insulator plate. The elements of the target system are cemented together in precise registration to form a rugged reliable unit that is low in cost, and that includes all the targets in a single focal plane positioned precisely and as accurately as one micron, which results in optical angular position accuracies of at least 20 microradians when the target is positioned in a long focal length optical system.

16 Claims, 4 Drawing Sheets

MULTI-WAVELENGTH TARGET SYSTEM

BACKGROUND OF THE INVENTION

1. Field of the Invention

This invention relates to a multi-wavelength target system that includes a single target pattern including at least one visible target, at least one near infrared target and at least one far infrared target in one rugged and rigid assembly. These targets are accurately positioned to permit optical alignment measurements of 30 microradians angular position accuracy.

2. Description of the Prior Art

Until now, target systems for optical test collimators have included three or more separate target members optically combined together to form a single optical target pattern (i.e., a composite target). Unfortunately, these target patterns failed to attain and retain the precise target registration required, typically less than 20 microradians, for making optical system alignment measurements of about 30 microradians angular accuracy with such target systems.

BRIEF SUMMARY OF THE INVENTION

This invention provides a target system, preferably with all targets in a single focal plane, that is especially adapted for use in a reflective optical collimator system. These target systems include a single target pattern means that includes at least one visible target, at least one near infrared target and at least one far infrared target. Behind the single target pattern means, and preferably joined directly to the single target pattern means, is a heat-transmitting target support means, which is preferably a metal support plate such as molybdenum, tungsten or beryllium. Behind the heat-transmitting target support means, and preferably joined directly to the back surface of the target support means, is a means for heating the single target pattern, which is preferably a heater plate that is adapted to be joined directly to and behind the target support means.

Behind the heating means is an insulating plate means, preferably joined directly to the heating means and preferably co-extensive with the heating means, and adapted to provide an even distribution of heat over the surface of the single target pattern means by preventing the heat from being conducted into the optical collimator material which might create optical distortion. Behind the insulator plate means are means for illuminating each of the visible and near-infrared targets in the single target pattern. Preferably, this illuminating means comprises a light source in registration with an aperture so that the light can pass through the aperture to provide a target. The illuminating means is placed directly behind the insulator plate means. In preferred embodiments, the heat-transmitting target support means, the heating means, and the insulator plate means have openings that are adapted to be placed in registration with one another to permit light to pass from the illuminating means directly to, and through, each of the patterns on the single target pattern means.

In preferred embodiments, the single target pattern means comprises a plurality of emissivity targets formed on a transparent substrate such as a zinc selenide or glass plate by a photolithographic process that forms, simultaneously, each of the targets. In the preferred embodiments, the visible targets are positioned near the perimeter of the single target pattern means, and the near infrared and far infrared targets, at or near the center of the single target pattern means. In preferred embodiments, each of the targets is spaced, with respect to the other targets and the center of the single target pattern means, with an accuracy of about one micron to produce an optical angular accuracy, preferably less than about 20 microradians, to permit alignment measurements of at least about 30 microradians measurement accuracy.

In preferred embodiments, the illuminating means comprises a plurality of light-emitting diodes, connected, behind the single target pattern means, some direct and some through fiber-optic connectors to a target. Preferably, the plurality of light-emitting diodes includes at least a first light-emitting diode and a second light-emitting diode, each of which transmits light of a different wavelength. In such embodiments, the light from the first light-emitting diode is adapted to be connected through fiber-optic connector means directly to at least one of the targets. So, too, is the light from the second light-emitting diode. Further, the light from each of the first and second light-emitting diodes can be combined, through a fiber-optic coupler, with the resulting combined light connected through a fiber-optic connector to another of the targets on the single target pattern means. In this way, a number of light-emitting diodes can be used to provide targets that emit light of widely differing wavelengths within the near infrared, far infrared and visible light ranges that emanate from the same, preferably one target pattern. The wavelengths emitted in the near-infrared and visible regions are selectable depending on which LED is electrically powered.

In preferred embodiments, the fiber-optic connectors are joined to the single target pattern directly behind the target openings formed on the single target pattern. In such embodiments, where the target system is adapted for use in a reflective optical system, the fiber-optic fibers are polished at angles other than an angle perpendicular to the longitudinal axis of the fiber-optic connectors to maximize the light directed at a selected angle into the collimator system. In preferred embodiments, the fiber-optic connector ends are polished at angles that deviate from the angle perpendicular to the longitudinal axis of the fiber-optic connectors in an amount in the range of about 2° up to about 10°, and preferably about 3°.

In preferred embodiments, the ends of the fiber optic connectors are connected to optical spheres, such as spheres made from sapphire glass, and the spheres are connected to the back of the single target pattern. These spheres increase the efficiency of collecting the light from the fiber optic connectors and projecting the light through target openings in the single target pattern means. These spheres refocus light from light-emitting diodes to a point within the single target pattern, and behind the target openings in the pattern. The spheres are used to increase the emission angle, and improve the efficiency of light transfer from the light-emitting diodes to the surface of the single test pattern. For example, by positioning one or more of the spheres properly, the light can be directed through a desired opening in the target at a precise, desired angle.

In preferred embodiments, the light-emitting diodes used to generate the light needed to illuminate each of the targets in the single test pattern are positioned in the same plane by means, e.g., a template (see FIG. 3) adapted to hold them in that plane and adapted to position the light-emitting diodes in perfect registration with each of the targets on the single target pattern.

In preferred embodiments, the multi-wavelength target system is made by forming a plurality of targets on the surface of a glass or a zinc selenide substrate by a computerized photolithography process, resulting in a pattern of emissivity targets, preferably with the near infrared and far infrared targets positioned near the center of the single target pattern, and the visible targets near its perimeter. The resulting emissivity target is, in preferred embodiments, joined by cementing or otherwise, to heat-transmitting target support member preferably made of molybdenum. A molybdenum heat-transmitting target support member conducts heat and distributes it relatively uniformly across the back surface of the single target pattern.

Where the single target pattern is an emissivity pattern formed by a photolithography process on a glass substrate, the preferred heat-transmitting member is made of molybdenum because glass and molybdenum have nearly the same thermal coefficient of expansion. Thus, the heater plate need not be molybdenum, but should be a material having a coefficient of expansion substantially similar to that of the substrate. Behind the molybdenum plate is a heater plate, preferably coextensive in size and shape with the molybdenum support member. Cemented behind the heater plate is a thermal insulator, preferably an insulator made of, for example, MACOR ®. The insulator plate is adapted to maintain a uniform temperature across the surface of the single test pattern, and to insulate the single test pattern from the optical system behind the insulator plate.

Behind the insulator plate, and joined directly thereto is a printed circuit card carrying two or more light-emitting diodes, each adapted to emit light of a wavelength different from the other. Tooling fixtures are preferably used to define the positions of the light-emitting diodes, and to guide these light-emitting diodes into position behind the targets in the single target pattern.

This alignment process is preferably carried out during the cementing process by backlighting the entire assembly, and visually centering the apertures in each of the single target patterns, the heat-distributing support plate, the heater plate, the insulator plate and the PC board. This step assures that the light-emitting diodes and the other elements in the system are properly aligned, centered and then joined together. Thereafter, some of the light-emitting diodes are linked to the back of the single target pattern through fiber-optic connectors whose ends are polished at angles other than the angle perpendicular to the longitudinal axis of the fiber-optic fiber. In preferred embodiments, the ends of the fiber-optic fibers are joined to glass spheres which in turn are cemented to the back of the single test pattern. The entire target system is then joined to a holding ring which is adapted to be placed in and affixed to a reflective optical cassegrain collimator system.

BRIEF DESCRIPTION OF THE DRAWINGS

The target system of this invention is mounted onto a reflective optical system adapted to receive the target system of this invention, and can better be understood by reference to the drawings, in which.

DETAILED DESCRIPTION OF THE INVENTION

Figure 1:
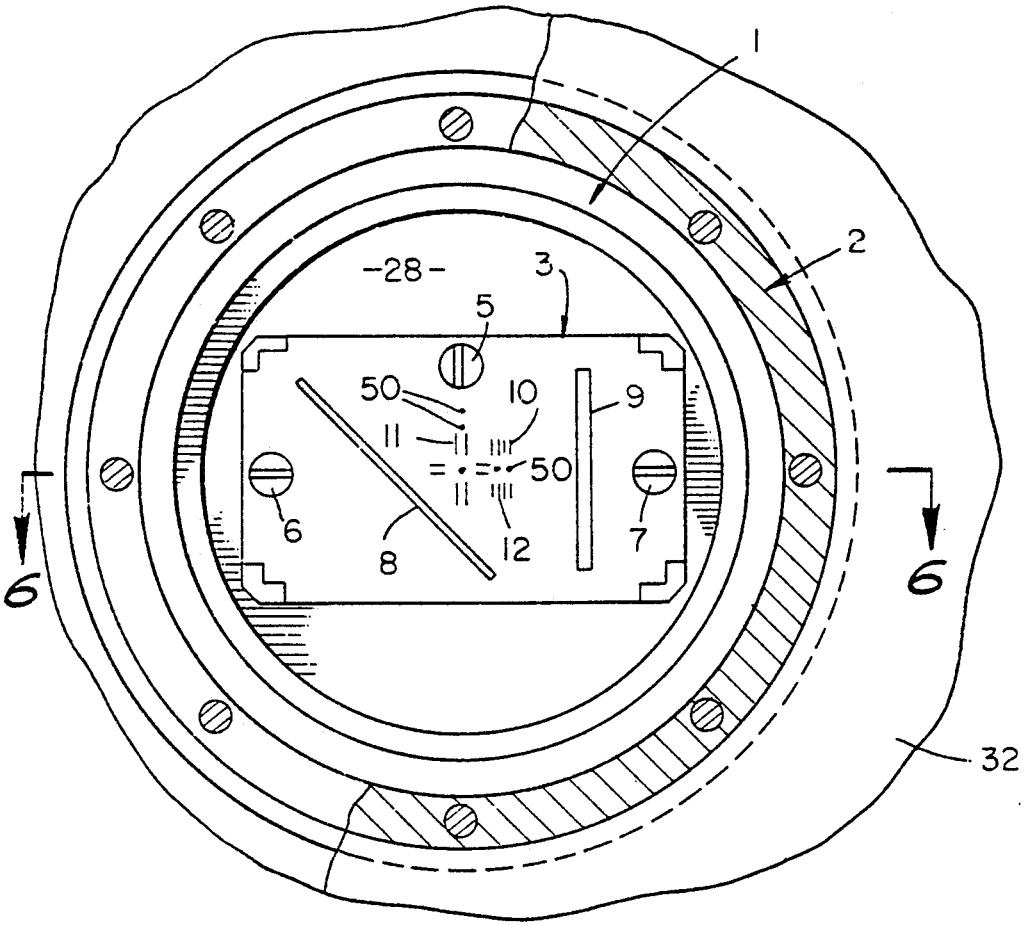
FIG. 1 shows a front elevational view of a preferred embodiment of the new target system.

FIG. 1 shows a front elevational view of the preferred embodiment of the new target system 1 mounted at the focal plane of a reflective optical collimator cassegrain system 32. The center of target system 1 is single target pattern 3 which is cemented to target support plate 28 (see FIG. 3). Single target pattern 3 includes visible light-opaque targets 5, 6 and 7, far-infrared (8-12 microns) emissivity target 11, in the form of a cross, and far infrared emissivity targets 8, 9, 10, 11 and 12 and several near-infrared LED targets 50. The far-infrared targets 8, 9, 10, 11 and 12 are created by the emissivity difference between coating 36 and glass surface 35 (see FIG. 5) where no coating is present. Far infrared emissivity targets 8, 9, 10, 11 and 12 are positioned near the center of single target pattern 3; visible light targets 5, 6 and 7, near the perimeter of single target pattern 3.

Figure 2:
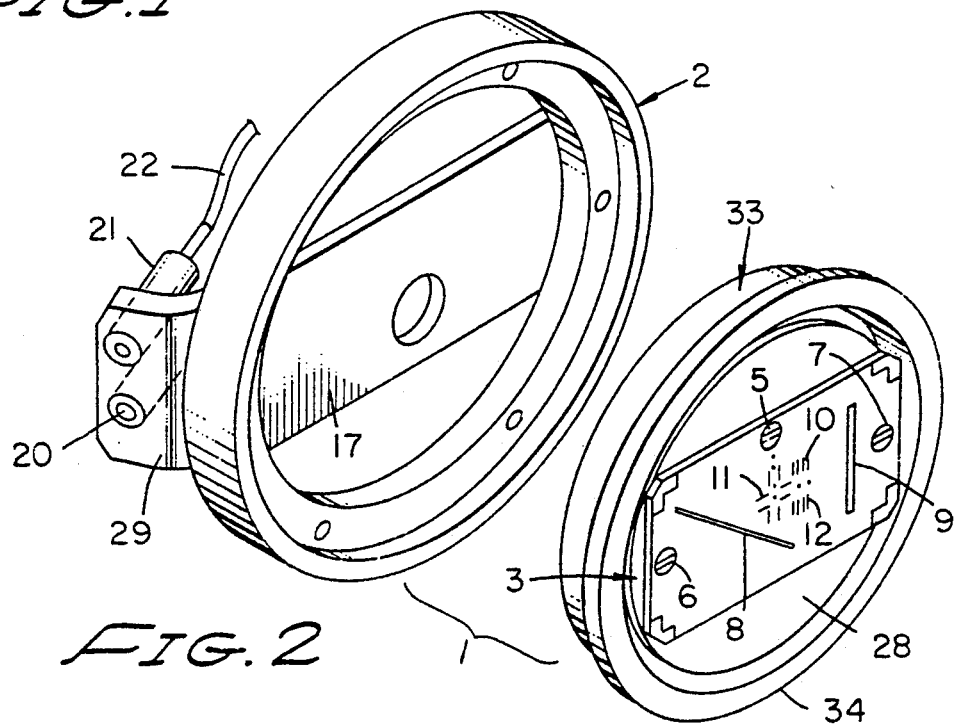
FIG. 2 shows an exploded perspective view of a target assembly from the embodiment shown in FIG. 1, separated from the holding ring for the target assembly.

As FIG. 2 shows, target system 1 includes target assembly 33, and is cemented to holding ring 2. Joined to the back of insulator 34 is PC board 17, which is joined to mounting bracket 29. Light-emitting diodes 20 and 21 are affixed to the back of mounting bracket 29, and their light combined by fiber-optic connectors 22 and spheres to illuminate center targets 50 on single target pattern 3. Other LED's are mounted behind target holes 50 of target pattern 3.

Figure 3:
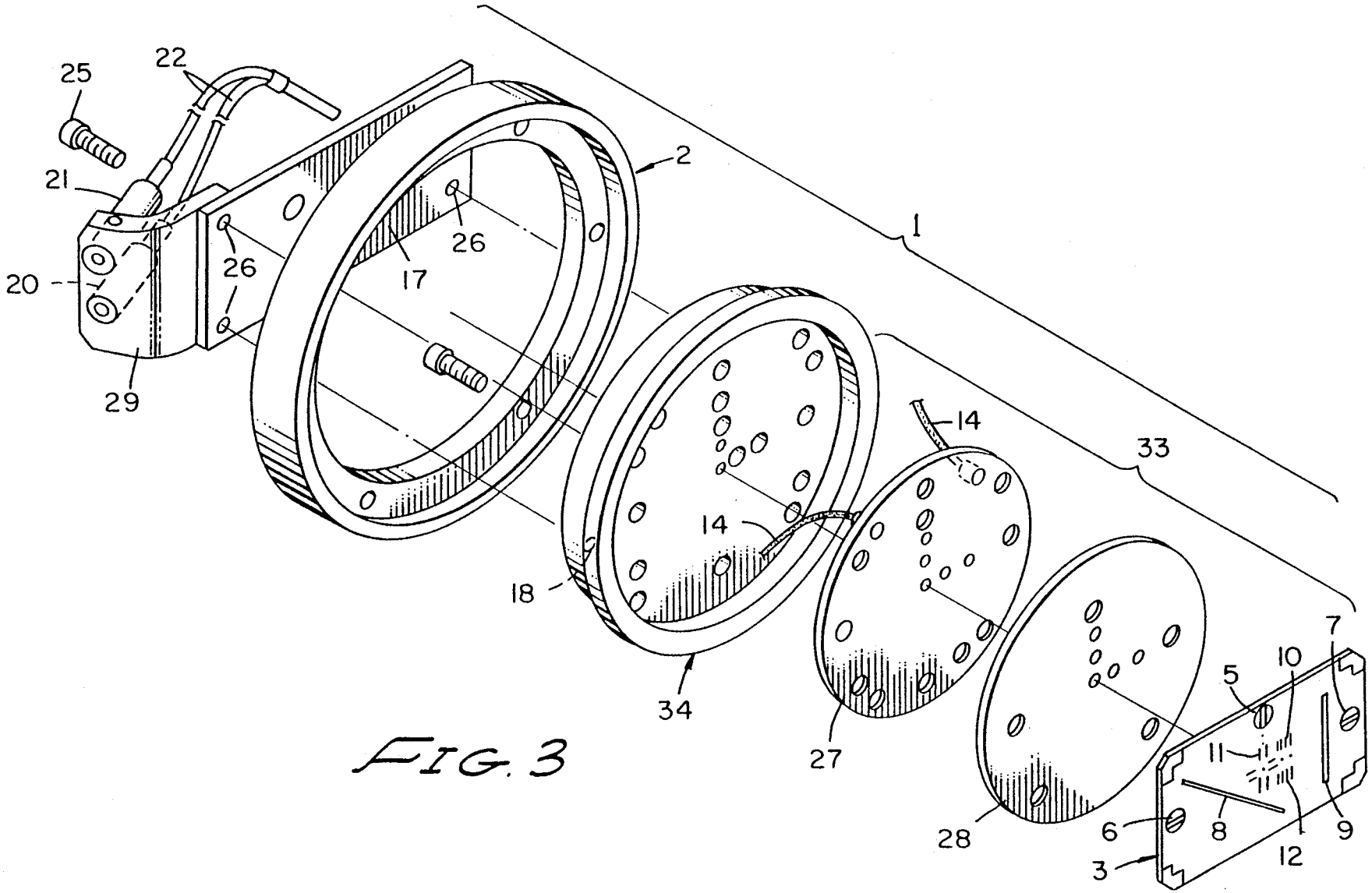
FIG. 3 is an exploded perspective view of the elements of the target assembly and holding ring for the embodiments shown in FIGS. 1 and 2.

FIG. 3 shows an exploded perspective view of the elements in target assembly 33. Target pattern 3 is joined to target support plate 28, preferably made of molybdenum. Target support plate 28 is, in turn, joined on its back surface to heating pad 27, which has leads 14 connected to a source of electrical energy. Behind heating pad member 27 is insulator member 34. Insulator 34 is preferably made of MACOR ®, which tends to insulate target pattern 3 from holding ring 2 and metal collimator 32, insuring an even distribution of heat over the entire surface of single target pattern 3. Behind MACOR ® insulator 34 is PC board 17, which is joined through bolts such as 25 that pass through openings such as 26 in PC board 17 and into threaded hole 18 in insulator 34.

Figure 5:
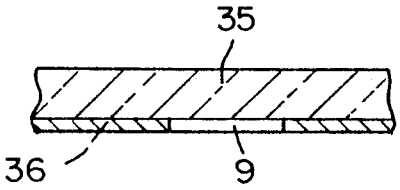
FIG. 5 is a cross-sectional view, taken on line 5—5, of FIG. 4, showing the construction of a representative emissivity target in the emissivity single target pattern shown in FIG. 4.
Figure 4:
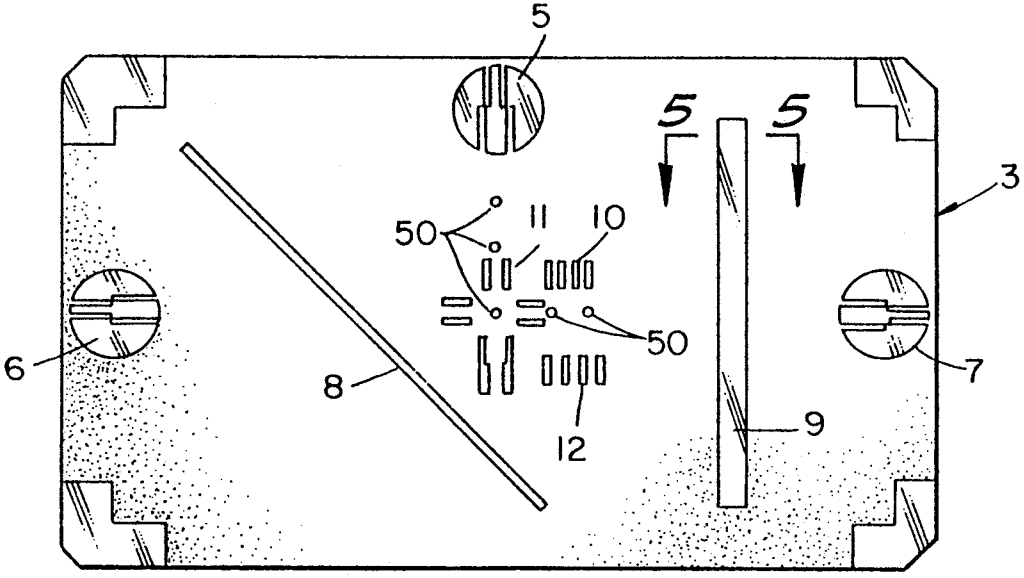
FIG. 4 is a front elevational view of the emissivity target in the preferred embodiment of the new target system shown in FIGS. 1-3.

FIG. 4 shows an enlarged front elevational view, and FIG. 5, a cross-sectional view, of the formation of emissivity targets 5, 6, 7, 8, 9, 10, 11, 12 and 50 on the surface of glass substrate 35. Glass substrate 35 has a coating 36 thereon which is converted to a pattern of targets through a photolithographic process, which results in the removal of the coating from the target openings 5, 6, 7, 8, 9, 10, 11, 12 and 50 in precise patterns and with spacing accuracy between the targets as small as one micron.

Figure 6:
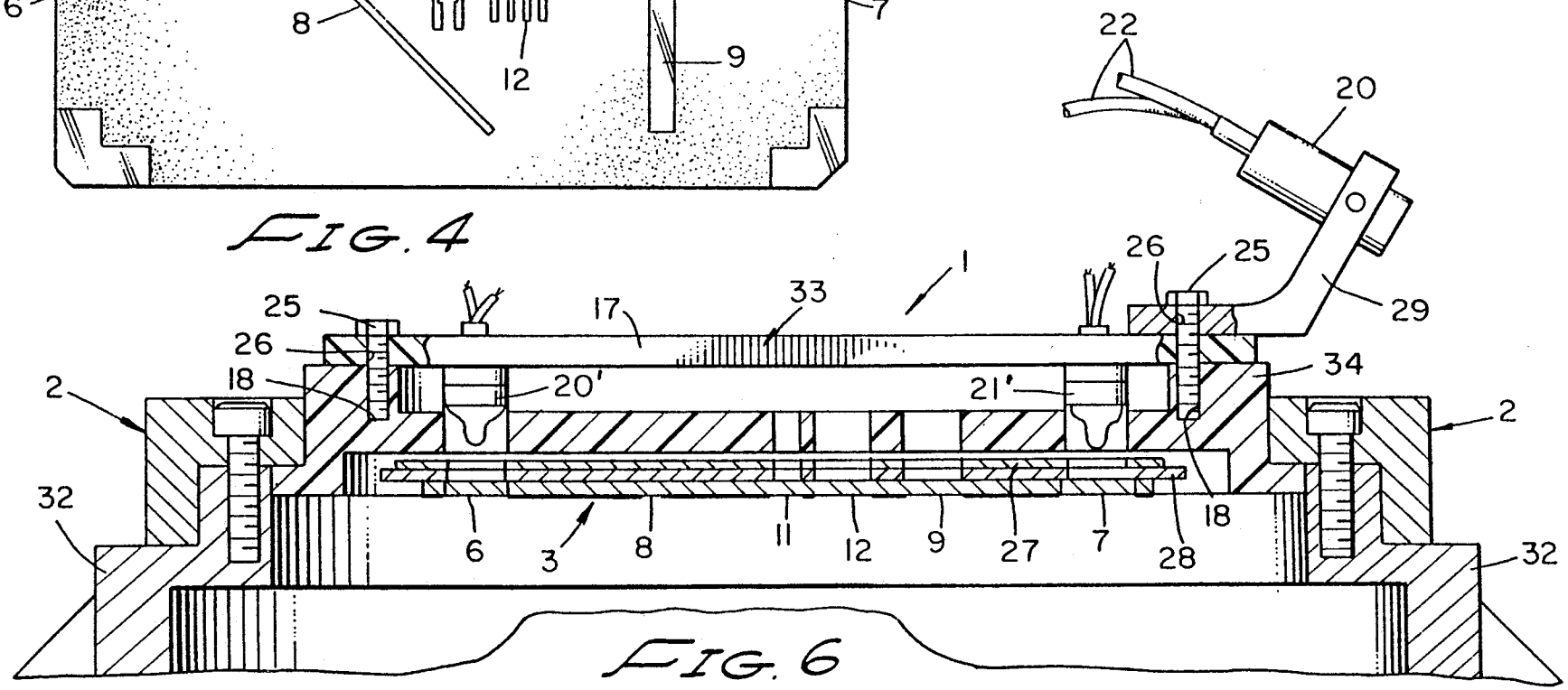
FIG. 6 shows a cross-sectional view, taken on line 6—6 of FIG. 1, of the preferred target system embodiment shown in FIGS. 1-5, and shows the visible LED's 20′ and 21′ illuminating visible targets 8 and 9 in target 3.

FIG. 6 shows a cross-sectional view, taken on line 6—6, in FIG. 1 and shows how visible light-emitting diodes 20' and 21' are positioned directly behind emissivity targets 5, 6 and 7 so that the light from these diodes passes through openings 5, 6 and 7 in target pattern 3.

Figure 7:
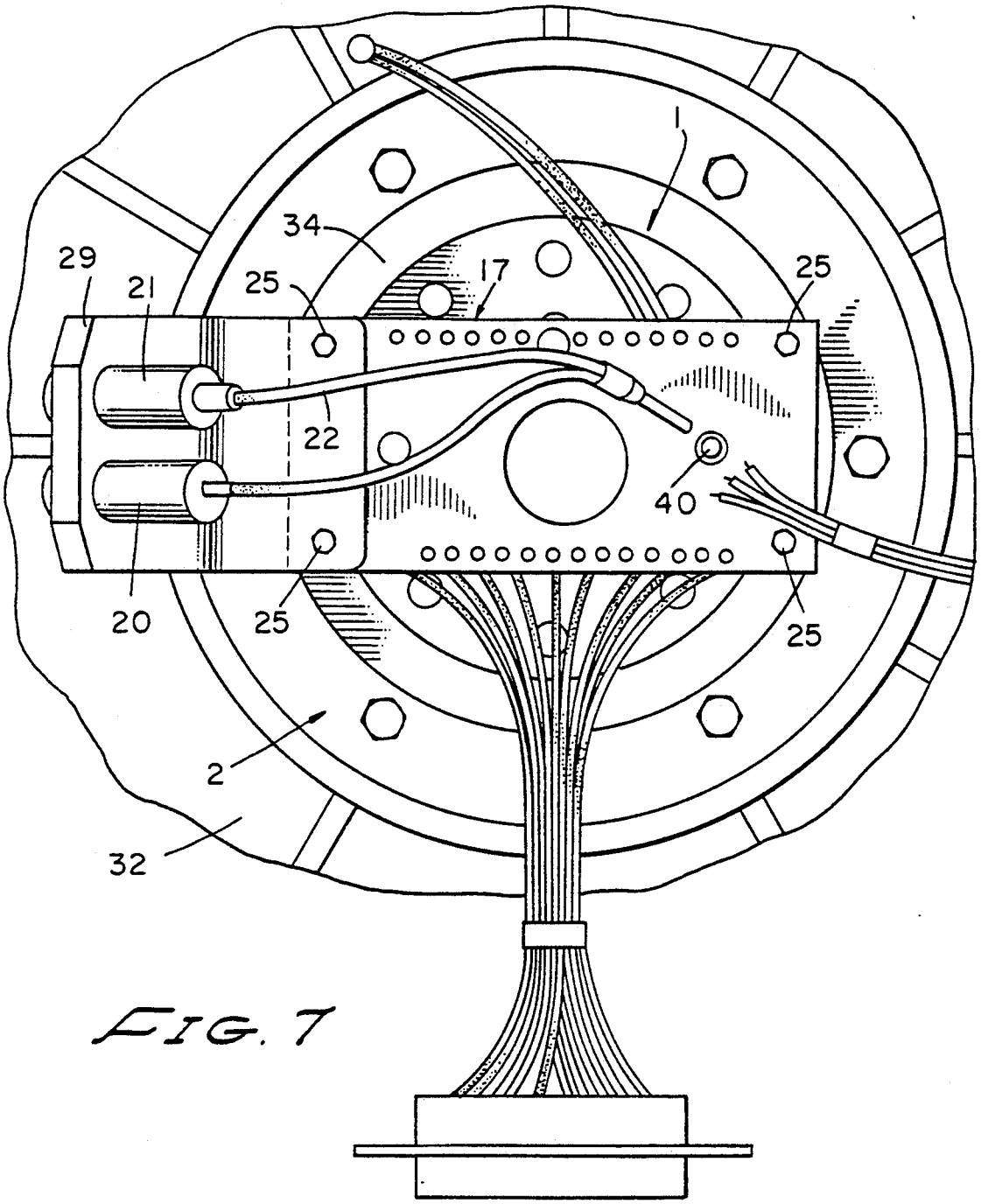
FIG. 7 shows a rear elevational view of the preferred target system embodiment shown in FIGS. 1-6.
Figure 8:
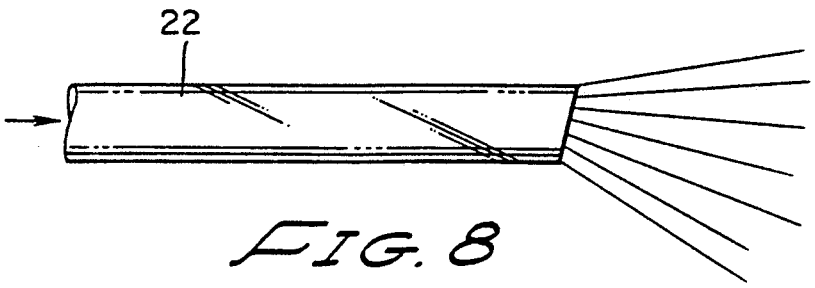
FIG. 8 shows an exploded detail view of an angled fiber end of the kind shown in FIG. 7.

FIG. 7 shows a rear elevational view of the construction of the target system shown in FIGS. 1–6. This is the mounting surface on the back of collimator 32. FIG. 7 shows how fiber-optic leads 22 extend from light-emitting diodes 20 and 21, which emit light of differing wavelengths, and direct the light from these diodes 20 and 21 via glass sphere 40 to the center near-infrared target opening on pattern 3. The other target holes 50 on pattern 3 are illuminated by single near-infrared LED's that are mounted on the PC board behind each of the holes.

The multi-wavelength target systems of this invention offer many advantages. Since all the target patterns, regardless of the wavelength of light to which they respond, are formed on the surface of a substrate such as a coated glass substrate, preferably by photolithography, the shape and pattern of the targets are spacially fixed. Thus, an optical alignment of the collimator containing this multi-wavelength target is highly resistant to displacement from shock and vibration.

Another advantage of these multi-wavelength targets is that the output from any one optical target pattern can be made to emit a particular wavelength of light in the visible, near-infrared or far-infrared region by electrically energizing the appropriate LED attached to the fiber linked to the target. Alternatively, any one optical target pattern can be made to emit a combination of wavelengths in the same way. In the preferred embodiment, the glass spheres collect, focus and transmit visible and near-infrared wavelengths of light.

If zinc selenide is used instead of glass for the substrate, all three spectral regions, namely visible, near-infrared and far-infrared targets can be made to emit from a single target pattern opening.

Another advantage is that the LED's or other far-infrared wavelength light sources that are connected to fibers can be modulated, electrically, or opto-mechanically, to meet the testing requirements of a system, both dynamically and statically.

What is claimed is:

1. A multi-wavelength target system comprising:

a single target pattern having at least one far infrared test target, at least one near infrared test target, and at least one visible light target;

heatings means coupled to said single target test pattern; and light illumination means having near infrared and visible light sources coupled to said single target test pattern, said far infrared test target for receiving infrared energy to emit a far infrared test pattern, said near infrared test target for receiving light to emit a near infrared test pattern, and said visible light test target for receiving light to emit a visible light test pattern.

2. The target system of claim 1 wherein said single target pattern, said heat-transmitting target support member, said heating means, said insulator means and said illuminating means are joined together to form a single rugged unitary assembly for inserting into an optical collimator system.

3. The target system of claim 2 wherein the end of each said fiber-optic connector joined to said targets is polished at a small angle other than perpendicular to the longitudinal axis of said fiber-optic connector to select the angle of maximum light directed into the optical collimator.

4. The target system of claim 3 wherein said angle on the fiber is in the range of about 2° to about 10° from said perpendicular.

5. The target system of claim 1 wherein said illuminating means comprises a plurality of light-emitting diodes connected, behind said single target pattern, through fiber-optic connectors, to each of said targets.

6. The target system of claim 5 wherein said plurality of light-emitting diodes includes at least a first light-emitting diode and a second light-emitting diode that emit light at different wavelengths, said first light-emitting diode being connected through fiber-optic connector means to at least one of said targets, said second light-emitting diode being connected through fiber-optic connector means to the same target, and wherein said light from said first and said second light-emitting diodes are combined through, and connected to at least one of said targets through a fiber-optic connector.

7. The target system of claim 1 wherein at least one of said targets is illuminated with light from light-emitting diode means.

8. The target system of claim 7 wherein each of said light-emitting diodes is connected behind at least one of said targets through optical spheres that focus light from said light-emitting diodes to a point behind said target.

9. The target system of claim 1 wherein each of said targets is spaced from the center of said single target pattern precisely to enable the target system when included in an optical collimator system to be used as a calibrated optical measuring or testing device.

10. The target system of claim 1 wherein said single target pattern comprises an emissivity target formed on a substrate.

11. The target system of claim 10 wherein said visible targets are positioned near the perimeter of said single target pattern and the near infrared and far infrared targets are positioned near the center of said single target pattern.

12. The target system of claim 11 wherein each of said targets is spaced, with respect to the other targets, as accurately as about one micron to produce an optical spacing accuracy of 20 microradians or less and to permit optical alignment measurements of about 30 microradians or less.

13. The target system of claim 1 wherein said visible targets are positioned near the perimeter of said single target pattern and the near infrared and far infrared targets are positioned near the center of said single target pattern.

14. The target system of claim 13 wherein each of said targets is spaced, with respect to the other targets, as accurately as about one micron to permit optical alignment measurements having an accuracy of at least about 20 microradians.

15. The target system of claim 1 wherein each of said targets is spaced, with respect to the other targets, with a positional accuracy of about one micron, which results in an optical accuracy of less than about 20 microradians and permits optical alignment measurements of at least about 30 microradians.

16. A multiwavelength target system comprising:

a substrate;

a plurality of test targets formed on the face of said substrate for emitting test patterns, whereby said plurality of test targets are all in the same focal plane; and infrared means coupled to a first test target on said substrate for driving said first test target to emit a far infrared test pattern, and light illumination means coupled to second and third test targets on said substrate for driving said second test target to emit a near infrared test pattern and for driving said third test target to emit a visible light test pattern.

* * * * *